US008328333B2

(12) United States Patent
Oikawa

(10) Patent No.: US 8,328,333 B2
(45) Date of Patent: Dec. 11, 2012

(54) RECORDING HEAD AND METHOD FOR MANUFACTURING THE SAME

(75) Inventor: Satoshi Oikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 209 days.

(21) Appl. No.: 12/870,716

(22) Filed: Aug. 27, 2010

(65) Prior Publication Data

US 2011/0141196 A1 Jun. 16, 2011

Related U.S. Application Data

(63) Continuation of application No. PCT/JP2009/070710, filed on Dec. 10, 2009.

(51) Int. Cl.
*B41J 2/14* (2006.01)

(52) U.S. Cl. ..... 347/50; 347/71; 347/85; 347/128; 347/141; 347/148; 257/21; 313/140; 313/141; 313/143; 313/144; 349/55; 445/7; 445/24

(58) Field of Classification Search ..... None
See application file for complete search history.

(56) References Cited

U.S. PATENT DOCUMENTS 4,502,062 A * 2/1985 Kunst ..... 347/141
5,404,157 A * 4/1995 Hosaka et al. ..... 347/128
5,831,660 A * 11/1998 Kubo et al. ..... 347/238
2005/0068381 A1 3/2005 Morita
2006/0209139 A1* 9/2006 Murata ..... 347/71
2007/0097191 A1* 5/2007 Morita ..... 347/85
2009/0246537 A1 10/2009 Matsuo

FOREIGN PATENT DOCUMENTS

JP 7-314685 12/1995
JP 2000-108343 4/2000
JP 2000-177134 6/2000
JP 2005-096422 4/2005
JP 2006-341557 12/2006
JP 2009-249403 10/2009

* cited by examiner

*Primary Examiner* — Matthew Luu
*Assistant Examiner* — John P Zimmermann
(74) *Attorney, Agent, or Firm* — Canon USA Inc IP Division

(57) ABSTRACT

One of an electric wiring substrate and a retaining member includes a section having an absorptance with respect to a laser beam, and the other one of the electric wiring substrate and the retaining member includes a section having a transmittance with respect to the laser beam. The electric wiring substrate and the retaining member are welded to each other by irradiation with a laser beam. At this time, the electric wiring substrate and the retaining member are welded to each other at least at a part of an outer peripheral section of the electric wiring substrate.

14 Claims, 9 Drawing Sheets

RECORDING HEAD AND METHOD FOR MANUFACTURING THE SAME

This application is a Continuation of International Application No. PCT/JP2009/070710, filed Dec. 10, 2009, which is hereby incorporated by reference herein in its entirety.

TECHNICAL FIELD

The present invention relates to a recording head for performing a recording operation on a recording medium and a method for manufacturing the recording head.

BACKGROUND ART

An inkjet recording head, which is a typical example of a recording head, generally includes a recording element substrate that ejects ink (liquid), an ink tank, which is a container for containing ink, and an electric wiring substrate that transmits ejection control signals and electric power for the ejection process to the recording element substrate. The recording element substrate is fixed to the ink tank that serves as a retaining member, and the electric wiring substrate is also fixed to the ink tank.

FIGS. 8A to 8C illustrate a structure according to the related art in which an electric wiring substrate H2000 is fixed by adhesion.

FIG. 8A illustrates an inkjet recording head viewed from the side of a recording element substrate H1000. In FIG. 8A, wires H2002 are shown in a see-through manner for explanation. FIG. 8B is a sectional view of FIG. 8A taken along line VIIIB-VIIIB. FIG. 8C is an enlarged view of part VIIIC in FIG. 8B.

As shown in FIG. 8A, the recording element substrate H1000 is disposed in an opening H2003 provided in the electric wiring substrate H2000. The electric wiring substrate H2000 and the recording element substrate H1000 are fixed to an ink tank H3000.

As shown in FIG. 8C, the electric wiring substrate H2000 has a layered structure including a first film H2010 composed of an insulator, a second film H2020 composed of an insulator, and a wiring layer H2030 including the wires H2002. The wires H2002 are connected to the recording element substrate H1000 at one end thereof, so that control signals and electric power can be transmitted from a main body in which the inkjet recording head is mounted to the recording element substrate H1000.

In general, the electric wiring substrate H2000 is fixed to the ink tank H3000 by an adhesive H4100, and an outer peripheral section of the electric wiring substrate H2000 is sealed by a sealant H4000 (Patent Literature 1).

However, according to the method of the related art in which the electric wiring substrate is fixed to the retaining member by applying the adhesive, there is a possibility that the adhesive cannot be applied to edge portions of the electric wiring substrate owing to, for example, uneven application of the adhesive.

As shown in FIG. 9A, there may be a case in which an edge portion of the electric wiring substrate is not fixed by the adhesive H4100 and therefore the edge portion of the electric wiring substrate H2000 is raised from the ink tank H3000. If the recording head is moved in this state in the recording operation, there is a possibility that the electric wiring substrate will come into contact with a recording medium P, such as a paper sheet, and become bent, as shown in FIG. 9B. In such a case, there is a risk that electric signals cannot be transmitted to the recording element substrate and the recording head cannot perform the ejecting function. In particular, the number of types of recording media has recently been increased, and there is a high possibility that the electric wiring substrate will be bent if a strong recording medium is used in a printing operation.

CITATION LIST

Patent Literature

PTL 1: Japanese Patent Laid-Open No. 2000-177134

SUMMARY OF INVENTION

According to the present invention, a method for manufacturing a recording head including a recording element substrate, an electric wiring substrate, and a retaining member for retaining the recording element substrate, the recording element substrate including recording elements configured to generate energy used for ejecting liquid, the electric wiring substrate being provided with an opening in which the recording element substrate is disposed and being electrically connected to the recording elements includes preparing the electric wiring substrate and the retaining member, one of the electric wiring substrate and the retaining member including a section having an absorptance with respect to a laser beam, the other one of the electric wiring substrate and the retaining member including a section having a transmittance with respect to the laser beam; and welding the electric wiring substrate and the retaining member to each other by irradiating with a laser beam a contact section in which the electric wiring substrate is brought into contact with a surface of the retaining member on which the recording element substrate is fixed at least at a part of an outer peripheral section of the electric wiring substrate, the contact section being irradiated with the laser beam through the section having the transmittance.

Further features of the present invention will become apparent from the following description of exemplary embodiments with reference to the attached drawings.

DESCRIPTION OF EMBODIMENTS (First Embodiment)

An embodiment of the present invention will be described with reference to FIGS. 1A to 5D.

Figure 2A:
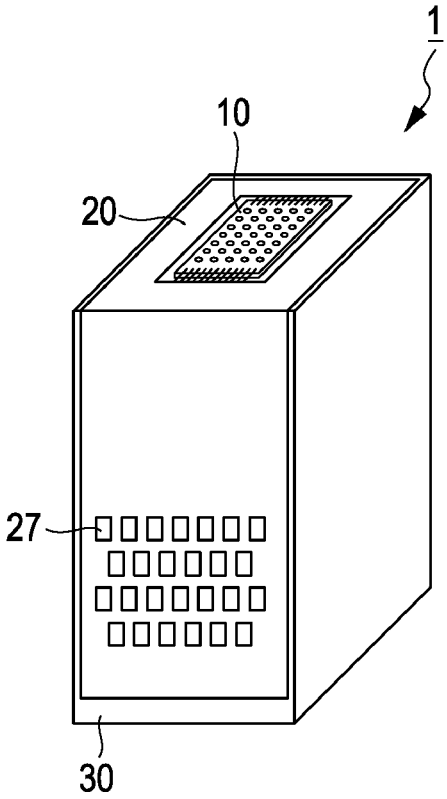
FIG. 2A is a schematic diagram of an inkjet recording head to which the present invention can be applied.
Figure 2B:
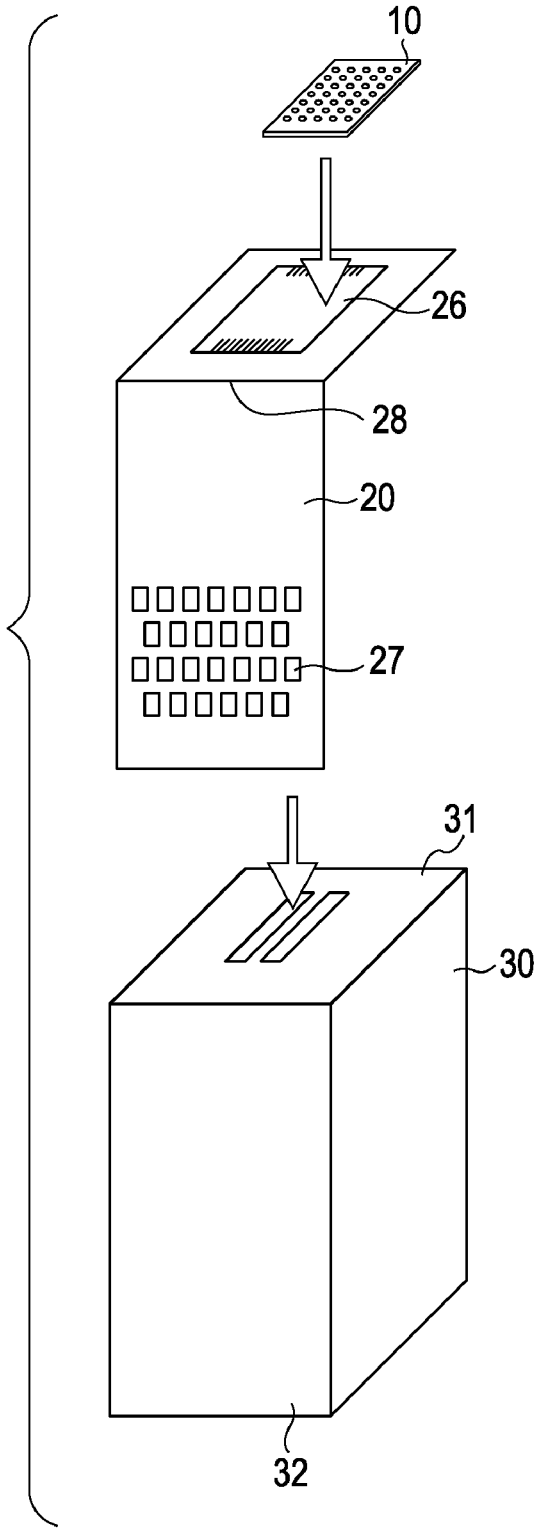
FIG. 2B is an exploded view of the inkjet recording head.

FIG. 2A is a schematic diagram of an inkjet recording head 1 to which the present invention can be applied, and FIG. 2B is an exploded view of the inkjet recording head 1. The inkjet recording head 1 includes a recording element substrate 10, an electric wiring substrate 20, and an ink tank 30. The recording element substrate 10 is fixed to a surface (first surface 31) of the ink tank 30, which serves as a retaining member, and the electric wiring substrate 20 is also fixed to the first surface 31 of the ink tank 30.

The inkjet recording head 1 is fixed to and supported by a positioning means of a carriage mounted in an inkjet recording apparatus, and is detachably attached to the carriage.

The recording element substrate 10 includes ejection orifices through which liquid (ink) is ejected and recording elements for ejecting the ink. The inkjet recording head 1 drives the recording elements, which generate energy used for discharging the ink, in accordance with electric signals transmitted from the inkjet recording apparatus. Accordingly, the ink, which is supplied from the ink tank 30 that contains the ink (liquid), is ejected through the ejection orifices. Thus, a recording operation on a recording medium is performed. The recording elements may be, for example, heating resistance elements or piezoelectric elements.

Figure 3:
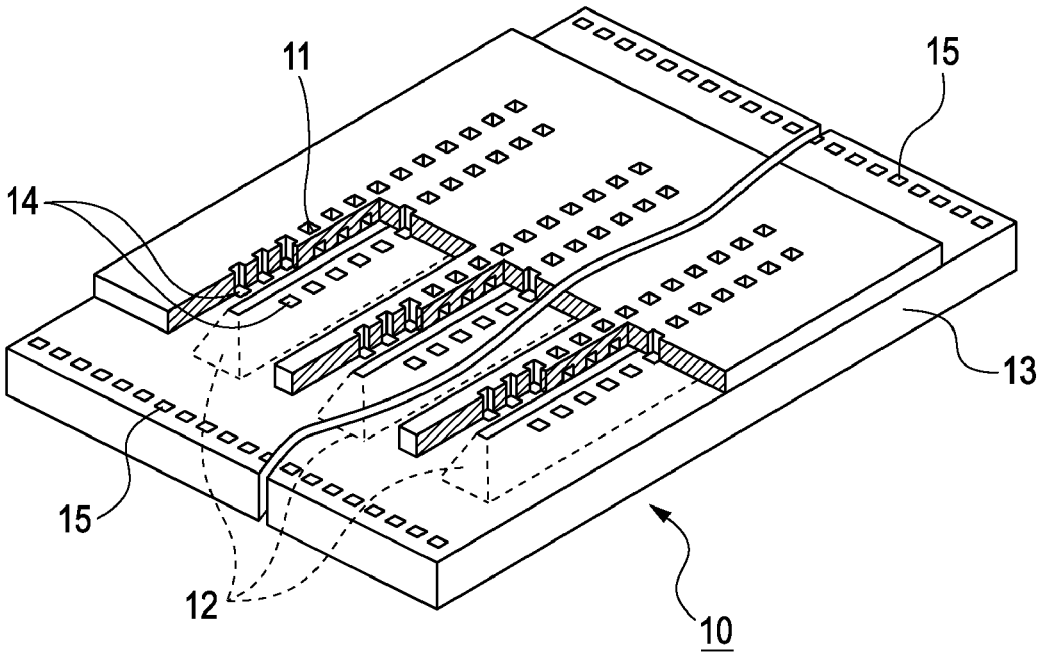
FIG. 3 is a perspective view of a recording element substrate included in the inkjet recording head to which the present invention can be applied.

FIG. 3 is a partially broken perspective view illustrating the structure of the recording element substrate 10.

The recording element substrate 10 includes ejection orifices 11 through which the ink is ejected and ink supply ports 12 which communicate with the ejection orifices 11 and through which the ink is supplied to the ejection orifices 11. The ink supply ports 12 are formed in a silicon substrate 13.

The silicon substrate 13 has a thickness in the range of 0.5 mm to 1.0 mm, and the ink supply ports 12 are formed in the silicon substrate 13 by anisotropic etching. Heating resistance elements 14, which serve as the recording elements, are formed on the silicon substrate 13. The ejection orifices 11 are formed above the silicon substrate 13 by photolithography such that the ejection orifices 11 correspond to the heating resistance elements 14. In addition, bumps 15 made of Au or the like are formed on the silicon substrate 13 as electrode elements for supplying electric signals and electric power for driving the heating resistance elements 14.

Figure 1A:
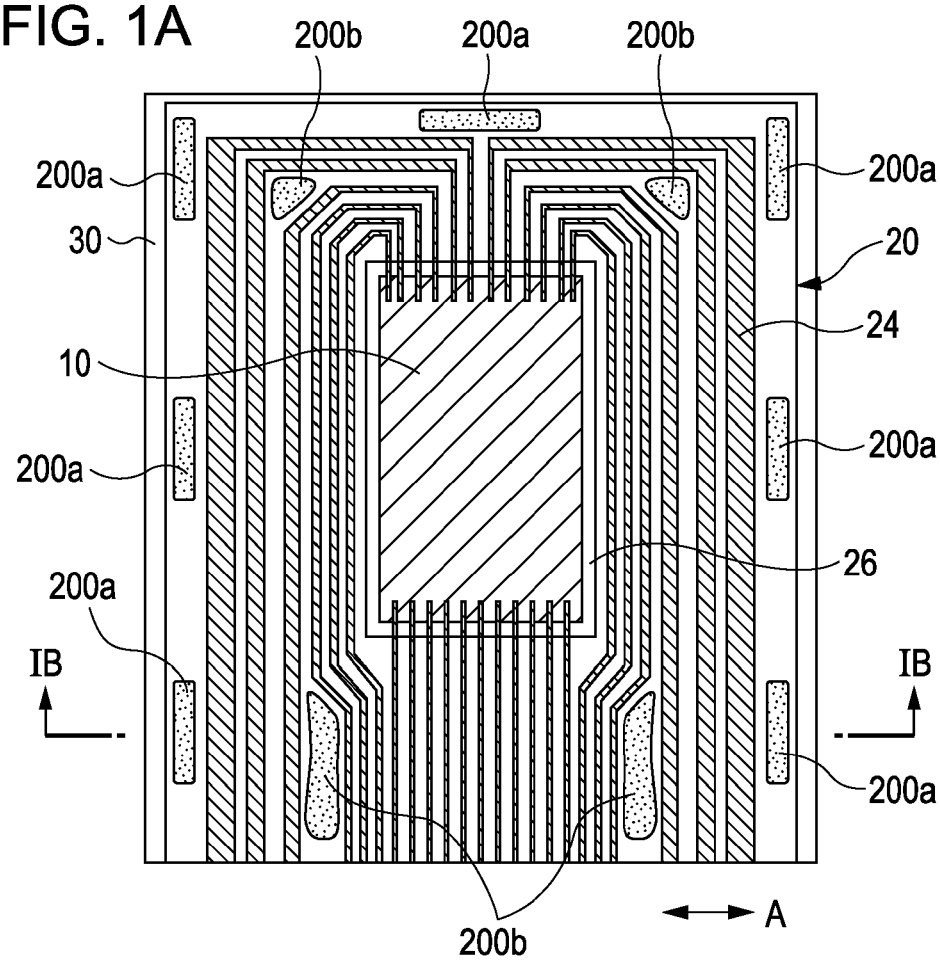
FIG. 1A is a schematic diagram illustrating a first embodiment of the present invention.
Figure 1B:
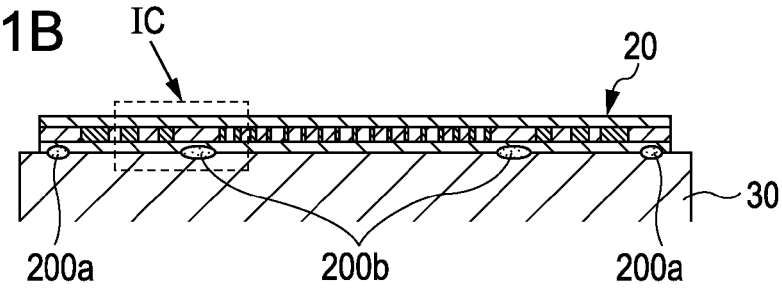
FIG. 1B is a schematic diagram illustrating the first embodiment of the present invention.
Figure 1C:
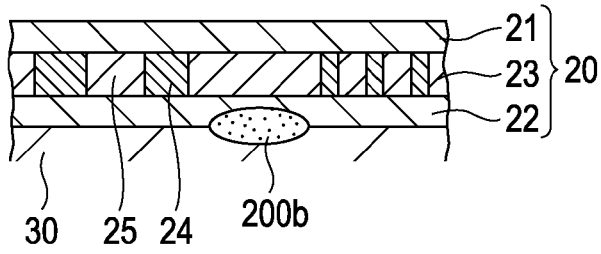
FIG. 1C is a schematic diagram illustrating the first embodiment of the present invention.

The electric wiring substrate 20 will now be described with reference to FIGS. 1A to 1C. FIG. 1A illustrates the inkjet recording head viewed from the side of the recording element substrate 10. Wires 24 are shown in a see-through manner for explanation in FIG. 1A and in other figures illustrating inkjet recording heads viewed from the side of the recording element substrate 10. FIG. 1B is a sectional view of FIG. 1A taken along line IB-IB. FIG. 1C is an enlarged view of part IC in FIG. 1B.

The electric wiring substrate 20 is electrically connected to the recording element substrate 10, and the electric signals are transmitted to the heating resistance elements 14 included in the recording element substrate 10 through the electric wiring substrate 20. The recording element substrate 10 is disposed within an opening 26 provided in the electric wiring substrate 20.

As shown in FIG. 1C, the electric wiring substrate 20 has a layered structure including a first film 21 (first insulator) composed of a film-shaped insulator, a second film 22 (second insulator) composed of a film-shaped insulator, and a wiring layer 23 including the wires 24. The wires 24 are protected by being interposed between the first film 21 and the second film 22. An adhesive 25 is applied to the wiring layer 23 for the purposes of filling gaps between the wires 24 and bonding the first film 21 and the second film 22 to the wiring layer 23. The wires 24 are made of a metal, such as Cu, having high conductivity, and the number of wires 24 required for a print control operation are arranged in parallel (the number of wires shown in the figure is reduced for simplicity). The wires 24 are connected to the bumps 15 on the recording element substrate 10 at one end thereof, so that control signals and electric power can be transmitted from the inkjet recording apparatus in which the inkjet recording head 1 is mounted to the recording element substrate 10.

In addition, as shown in FIG. 2B, the wires 24 are connected to signal input terminals 27, which are provided on the electric wiring substrate 20 for receiving signals from the inkjet recording apparatus, at the other end thereof. A section of the electric wiring substrate 20 in which the opening 26 for receiving the recording element substrate 10 is formed is fixed to the first surface 31 of the ink tank 30, and a section of the electric wiring substrate 20 on which the signal input terminals 27 are provided is fixed to a second surface 32, which is different from the first surface 31, of the ink tank 30. Accordingly, the electric wiring substrate 20 includes a bent portion 28 which is bent from the first surface 31 toward the second surface 32.

A method for fixing the electric wiring substrate 20 to the ink tank 30 according to the present embodiment will now be described.

According to the present invention, the electric wiring substrate 20 is fixed to the ink tank 30 by using a laser beam. Therefore, in the present embodiment, the ink tank 30 is formed as a component that has an absorptance with respect to the laser beam. In addition, components of the electric wiring substrate 20 other than the wires 24, that is, the first film 21, the second film 22, and the adhesive 25, are formed as components having a transmittance with respect to the laser beam.

A method for manufacturing the recording head using the laser beam according to the present embodiment will now be described.

First, welding surfaces of the electric wiring substrate 20 and the ink tank 30 are brought into contact with each other. Next, a contact section in which the second film 22 and the ink tank 30 are in contact with each other is irradiated with the laser beam through the first film 21, the second film 22, and the adhesive 25, which have a transmittance in the electric wiring substrate 20. The contact section can be easily irradiated with the laser beam since the laser beam is directed through the electric wiring substrate 20, which has a thin film shape, instead of the ink tank 30 which serves as a housing.

In response to the irradiation with the laser beam, dye or pigment included in the ink tank 30, which has an absorptance, generates heat and melts. The generated heat is transmitted to the second film 22. The second film is made of a material having a melting point that is close to a melting point of the ink tank 30, so that the second film 22 also melts when the heat is transmitted thereto. As a result, the contact section is changed into a welded section, and the electric wiring substrate 20 and the ink tank 30 are bonded to each other.

Positions at which the electric wiring substrate 20 and the ink tank 30 are welded to each other by directing the laser beam will now be described with reference to FIGS. 1A to 1C.

Sections (welded sections) in which the ink tank 30 and the electric wiring substrate 20 are welded to each other by the irradiation with the laser beam are denoted by 200 (200*a*, 200*b*). The wires 24 made of metal do not transmit the laser beam. Therefore, the welded sections 200 are provided in regions where the wires 24 are not arranged. The welded sections 200 include welded sections 200*a* formed at the edge portions of the electric wiring substrate 20 in an outer peripheral section thereof.

In the case where components are welded to each other using a laser beam, the components can be welded at desired positions. Therefore, in the case where the electric wiring substrate 20 and the ink tank 30 are welded to each other using the laser beam, the electric wiring substrate 20 can be bonded to the ink tank 30 with high accuracy even at the edge portions of the electric wiring substrate 20. Accordingly, the welded sections 200*a* are formed by using the laser beam in the outer peripheral section of the electric wiring substrate 20, so that the possibility that the electric wiring substrate 20 will come into contact with the recording medium, such as a paper sheet, and become bent in a printing operation can be reduced and the electrical reliability of the recording head can be increased.

The problem that the electric wiring substrate 20 will be bent by the recording medium tends to occur at the edge portions of the electric wiring substrate 20 in the scanning direction of the recording head (direction shown by arrow A in FIG. 1A) and corner portions of the electric wiring substrate 20 in the outer peripheral section of the electric wiring substrate 20. Therefore, the above-described problem can be effectively avoided by forming the welded sections 200*a* at the above-mentioned portions in the outer peripheral section of the electric wiring substrate 20.

In addition, in the method according to the related art in which the adhesive is used, a step of waiting for a long time for the adhesive to cure and a step of sealing the outer peripheral section of the electric wiring substrate 20 with a sealant are necessary. In contrast, according to the present embodiment in which the welding process is performed using the laser beam, the number of steps of the manufacturing method can be reduced.

In the present embodiment, to ensure the bonding strength between the electric wiring substrate 20 and the ink tank 30, a plurality of welded sections 200*b* are formed by welding the electric wiring substrate 20 and the ink tank 30 to each other at positions between the wires 24. Since the electric wiring substrate 20 and the ink tank 30 are welded to each other also at positions between the wires 24, the electric wiring substrate 20 can be more reliably fixed to the ink tank 30 compared to the case in which only the welded sections 200*a* in the outer peripheral section are formed.

Figure 4A:
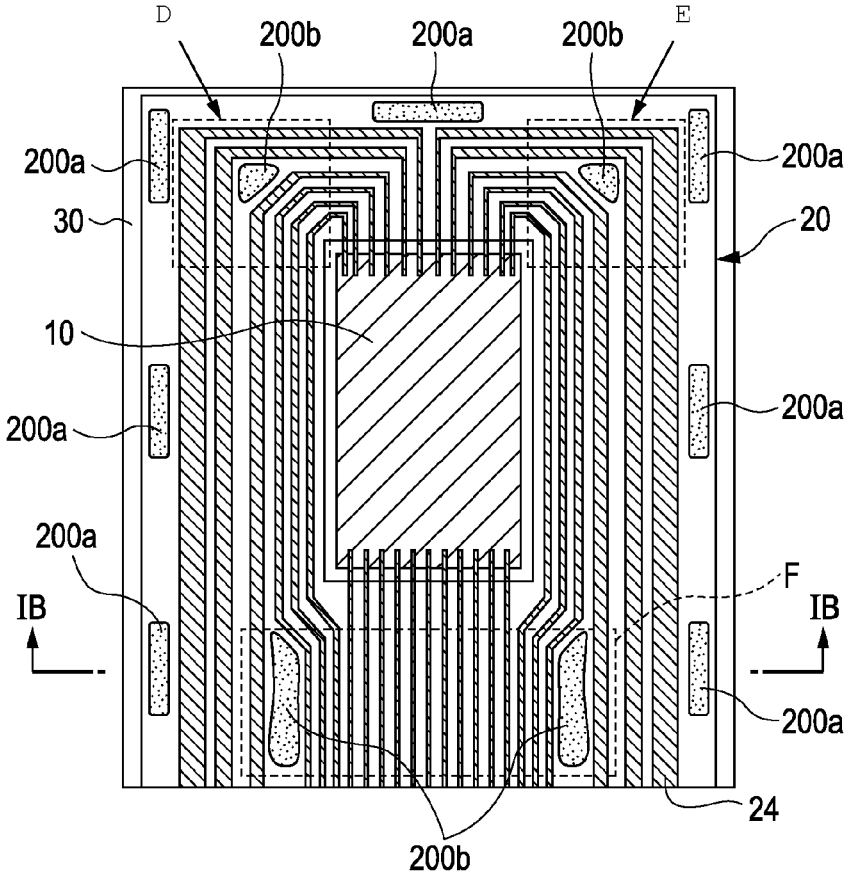
FIG. 4A is a schematic diagram for explaining the first embodiment of the present invention.
Figure 4B:
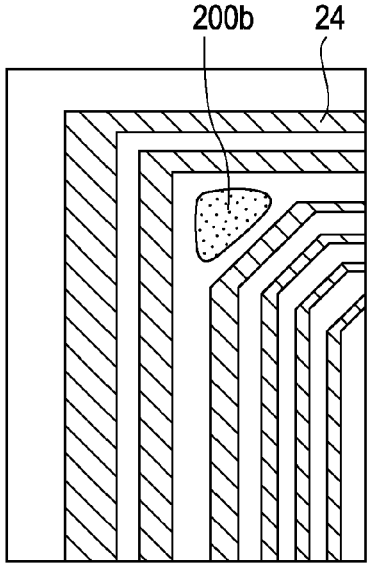
FIG. 4B is a schematic diagram for explaining the first embodiment of the present invention.

Positions at which the welded sections 200*b* are formed according to a more preferred embodiment will be described with reference to FIGS. 4A to 4C. FIG. 4A illustrates the inkjet recording head viewed from the side of the recording element substrate 10. FIG. 4B is an enlarged view of area D surrounded by the broken lines in FIG. 4A.

Figure 4C:
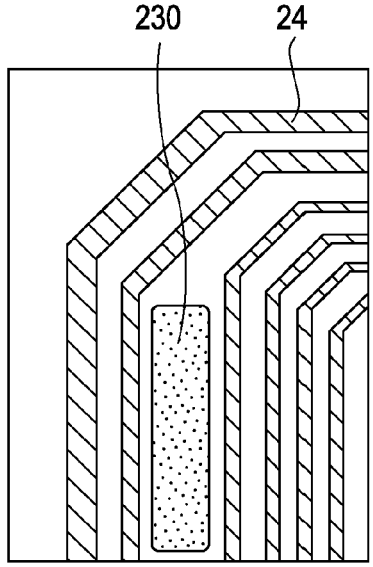
FIG. 4C is a schematic diagram for explaining the first embodiment of the present invention.

FIG. 4C is a diagram illustrating the structure in which a welded section 230 is provided between the wires 24 arranged parallel to the recording element substrate 10. Since the opening 26 for receiving the recording element substrate 10 is formed in the electric wiring substrate 20 in a region where the wires 24 are arranged parallel to the recording element substrate 10, the density of the wires 24 in this region is higher than that in other regions. Therefore, to form the welded section 230 in this region without increasing the area of the electric wiring substrate 20, the thickness of the wires 24 must be reduced as shown in FIG. 4C to provide the space for forming the welded section 230. However, if the thickness of the wires 24 is reduced, the electrical resistance increases.

Therefore, as in areas D and E shown in FIG. 4A, at the corners where the wires 24 are bent, the outer wires 24 are bent perpendicularly while the inner wires 24 are bent such that areas for forming the welded sections can be provided. The welded sections 200*b* are formed in the thus-provided areas. In this case, it is not necessary to reduce the thickness of the wires 24. Therefore, the recording head can be used with suitable electric power and the durability of the recording head can be increased.

In area F shown in FIG. 4A, sufficient spaces for arranging the wires 24 are provided since the wires 24 are not arranged parallel to the opening 26. Therefore, the welded sections 200*b* can be formed without reducing the thickness of the wires 24 by forming the wires 24 in a bent shape as in area F.

In the present embodiment, the wires 24 are bent in areas D, E, and F as shown in FIG. 4A to provide spaces for forming the welded sections. However, the manner in which the wires 24 are bent is not limited to that shown in the figure as long as the spaces for forming the welded sections can be provided by forming the wires 24 in a bent shape.

Next, the structure in which the welding strength in the welded sections 200 can be increased will be described with reference to FIGS. 5A to 5D.

In the case where components are welded and bonded together by irradiating the components with the laser beam, the bonding strength varies in accordance with the level of contact between the components at the time when the components are irradiated with the laser beam. FIG. 5D illustrates the layered structure of the electric wiring substrate 20. In the electric wiring substrate 20 in which the wires 24 made of metal are disposed, the thickness of the electric wiring substrate 20 in areas where the wires 24 are disposed slightly differ from that in areas free from the wires 24 where the adhesive 25 is disposed. Here, the difference in thickness is exaggerated in FIG. 5D. Portions of the second film 22 which are free from the wires 24 and at which the thickness is small correspond to the areas where the welded sections are formed.

Figure 5A:
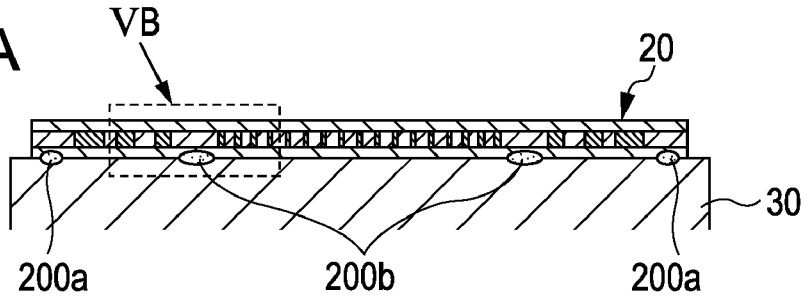
FIG. 5A is a schematic diagram for explaining the shape of welding sections of an ink tank according to an embodiment of the present invention.
Figure 5B:
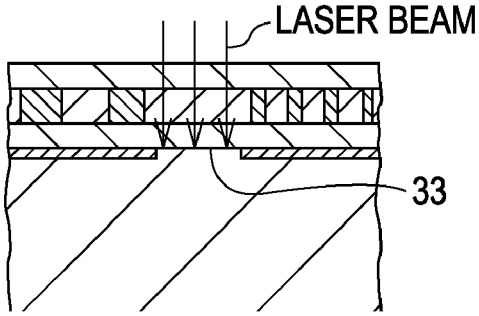
FIG. 5B is a schematic diagram for explaining the shape of welding sections of the ink tank according to the embodiment of the present invention.
Figure 5C:
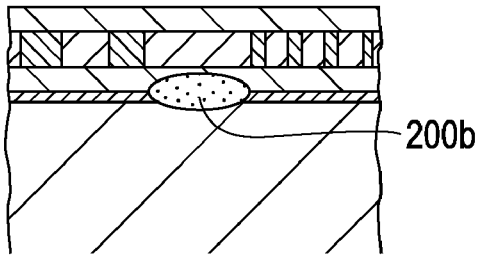
FIG. 5C is a schematic diagram for explaining the shape of welding sections of the ink tank according to the embodiment of the present invention.
Figure 5D:
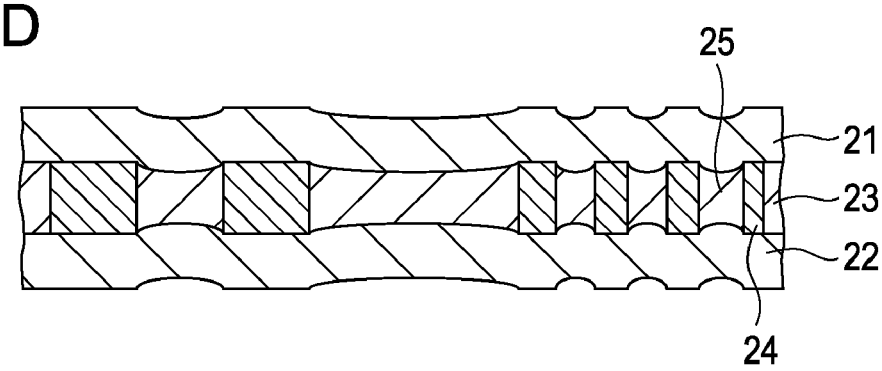
FIG. 5D is a schematic diagram for explaining the shape of welding sections of the ink tank according to the embodiment of the present invention.

Accordingly, as shown in FIG. 5B, which is an enlarged view of area C shown in FIG. 5A, before the welding process is performed a projecting portion 33 which projects from the first surface 31 of the ink tank 30 toward the electric wiring substrate 20 is formed on the ink tank 30 in an area where the welded section is to be formed. Therefore, the ink tank 30 and the electric wiring substrate 20 can be brought into contact with each other with a higher degree of contact, and can therefore be more strongly bonded to each other.

In the present embodiment, the laser beam is transmitted through the first film 21, the second film 22, and the adhesive 25 of the electric wiring substrate 20. Since the laser beam is transmitted through the adhesive 25, there is a possibility that the laser beam cannot be suitably directed to the contact section. Therefore, to increase the reliability of the welding process, the electric wiring substrate 20 is preferably structured as follows.

That is, for example, the electric wiring substrate 20 may be structured such that hollow spaces are provided instead of the spaces filled with the adhesive 25 in areas corresponding to the welded sections, or such that both the adhesive 25 and the first film are removed and only the second film is provided in the areas corresponding to the welded sections. Alternatively, a component having a high transmittance with respect to the laser beam may be disposed instead of the adhesive 25 in areas corresponding to the welded sections in the electric wiring substrate 20. In such a case, the reliability of the welding process can be increased while maintaining the flatness of the electric wiring substrate 20.

In the present embodiment, the component having a transmittance with respect to the laser beam means the component which transmits 30% or more of the laser beam incident thereon. In addition, in the present invention, a component having an absorptance with respect to the laser beam means the component which absorbs 90% or more of the laser beam incident thereon. The component having a transmittance and the component having an absorptance can be laser-welded to each other when the components have the transmittance and the absorptance defined as described above. The laser beam used for the laser irradiation is not limited as long as the laser beam has a wavelength such that the laser beam can pass through the component having a transmittance.

A method for irradiating the sections to be welded with the laser beam may either be a scanning method in which the sections to be welded are scanned by the laser beam or a batch method in which a mask is used so that only the sections to be welded are irradiated with the laser beam. Either method may be used in the present invention. The method for irradiating the sections to be welded with the laser beam is not particularly limited.

According to the present embodiment, the ink tank 30 has an absorptance and components of the electric wiring substrate 20 other than the wires 24 have a transmittance. However, according to the present invention, either one of the two components that are to be welded together may have an absorptance as long as the other one has a transmittance. In the case where the ink tank 30 has a transmittance, unlike the present embodiment, the sections to be welded are irradiated with the laser beam through the ink tank 30. Therefore, only the second film 22 is required to have an absorptance in the electric wiring substrate 20. In addition, in this case, the welded sections may be formed in areas corresponding to the positions where the wires 24 are disposed. Therefore, the versatility of the positions of the welded sections can be increased.

In the present embodiment, the recording head is integrated with the ink tank 30. However, the recording head may also include a tank holder for holding the ink tank 30. In such a case, the recording element substrate and the electric wiring substrate are bonded to the tank holder.

The risk that the electric wiring substrate 20 will be bent by coming into contact with the recording medium can be reduced by welding the electric wiring substrate 20 using the laser beam at portions of the outer peripheral section of the electric wiring substrate 20. Therefore, sections other than the outer peripheral section may be bonded by using an adhesive.

(Second Embodiment)

A second embodiment of the present invention will be described with reference to FIG. 7.

Figure 7:
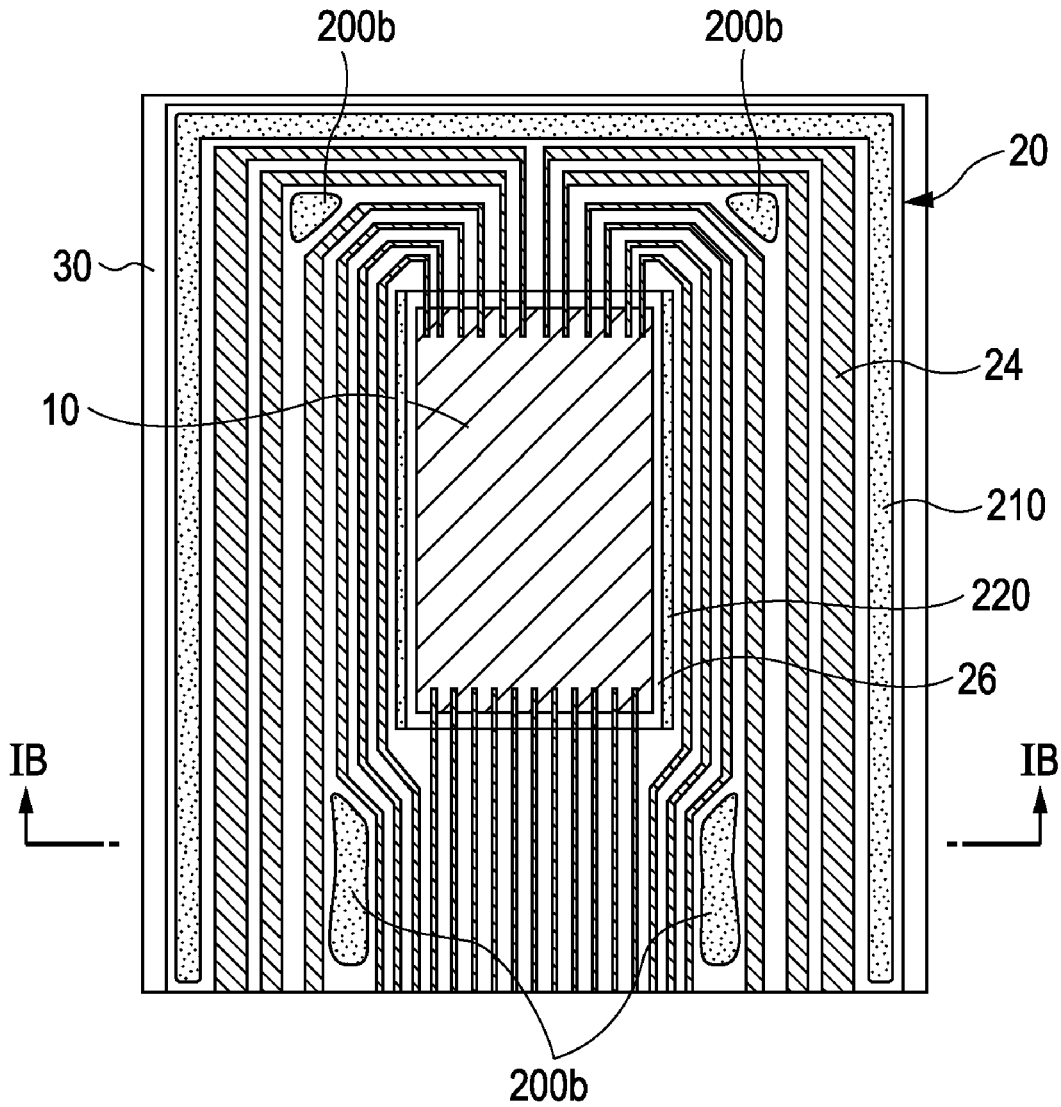
FIG. 7 is a schematic diagram illustrating the second embodiment of the present invention.
Figure 8A:
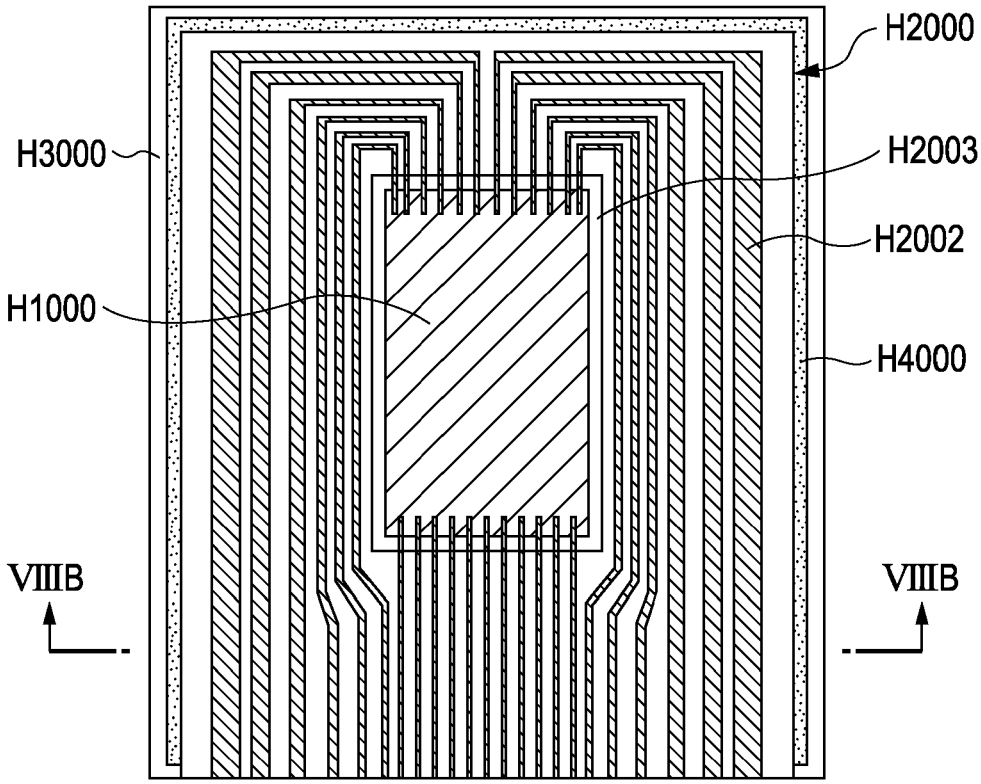
FIG. 8A is a diagram for explaining a method for fixing an electric wiring substrate to an ink tank using an adhesive according to the related art.
Figure 8B:
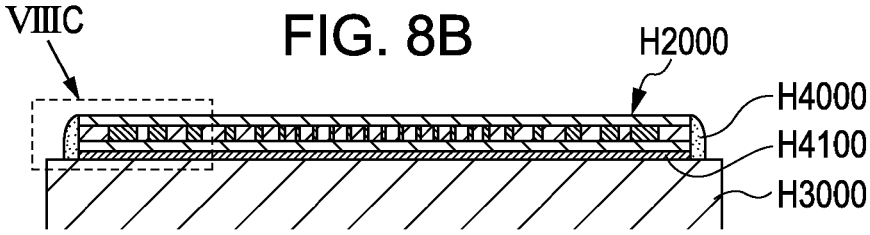
FIG. 8B is a diagram for explaining the method for fixing the electric wiring substrate to the ink tank using the adhesive according to the related art.
Figure 8C:
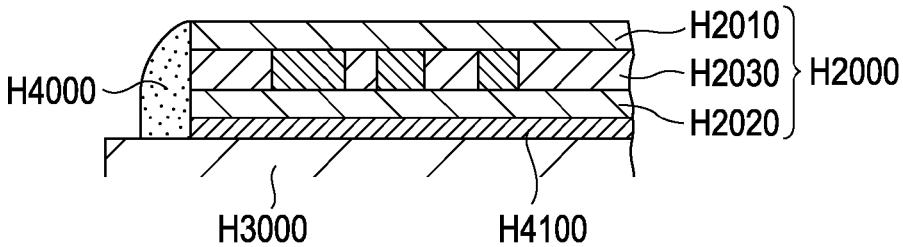
FIG. 8C is a diagram for explaining the method for fixing the electric wiring substrate to the ink tank using the adhesive according to the related art.
Figure 9A:
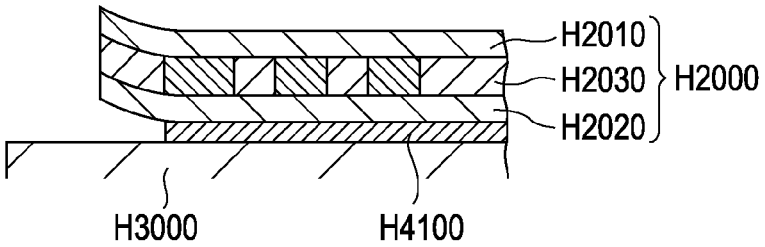
FIG. 9A is a diagram for explaining the manner in which the electric wiring substrate comes into contact with a recording medium when the electric wiring substrate is bent.
Figure 9B:
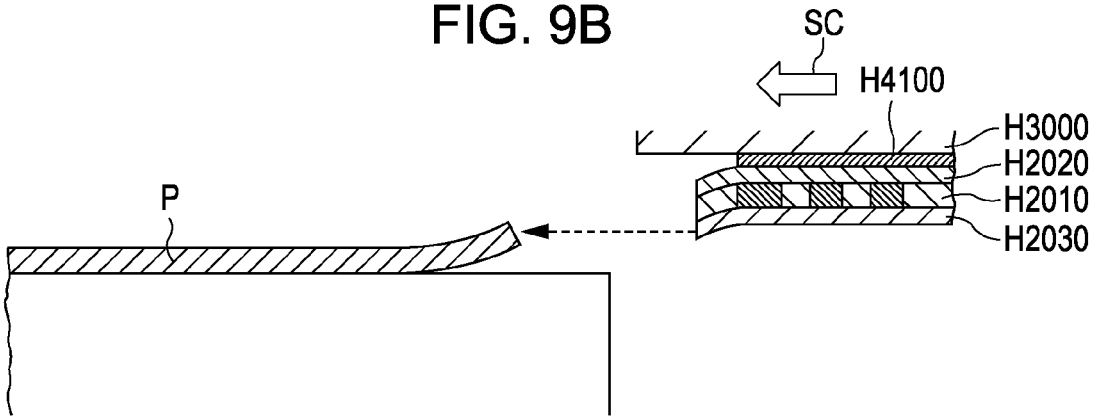
FIG. 9B is a diagram for explaining the manner in which the electric wiring substrate comes into contact with the recording medium when the electric wiring substrate is bent.

In the present embodiment, unlike the first embodiment in which the welded sections are partially provided in the outer peripheral section of the electric wiring substrate 20, a welded section 210 is provided such that the welded section 210 extends continuously, as shown in FIG. 7. The other structures of the second embodiment are similar to those of the first embodiment, and explanations thereof are thus omitted.

During the operation of the inkjet recording apparatus, ink mist and the like adhere to the electric wiring substrate 20 in a peripheral area thereof. Problems caused by this ink in the inkjet recording head 1 will now be described with reference to FIGS. 6A and 6B.

Figure 6A:
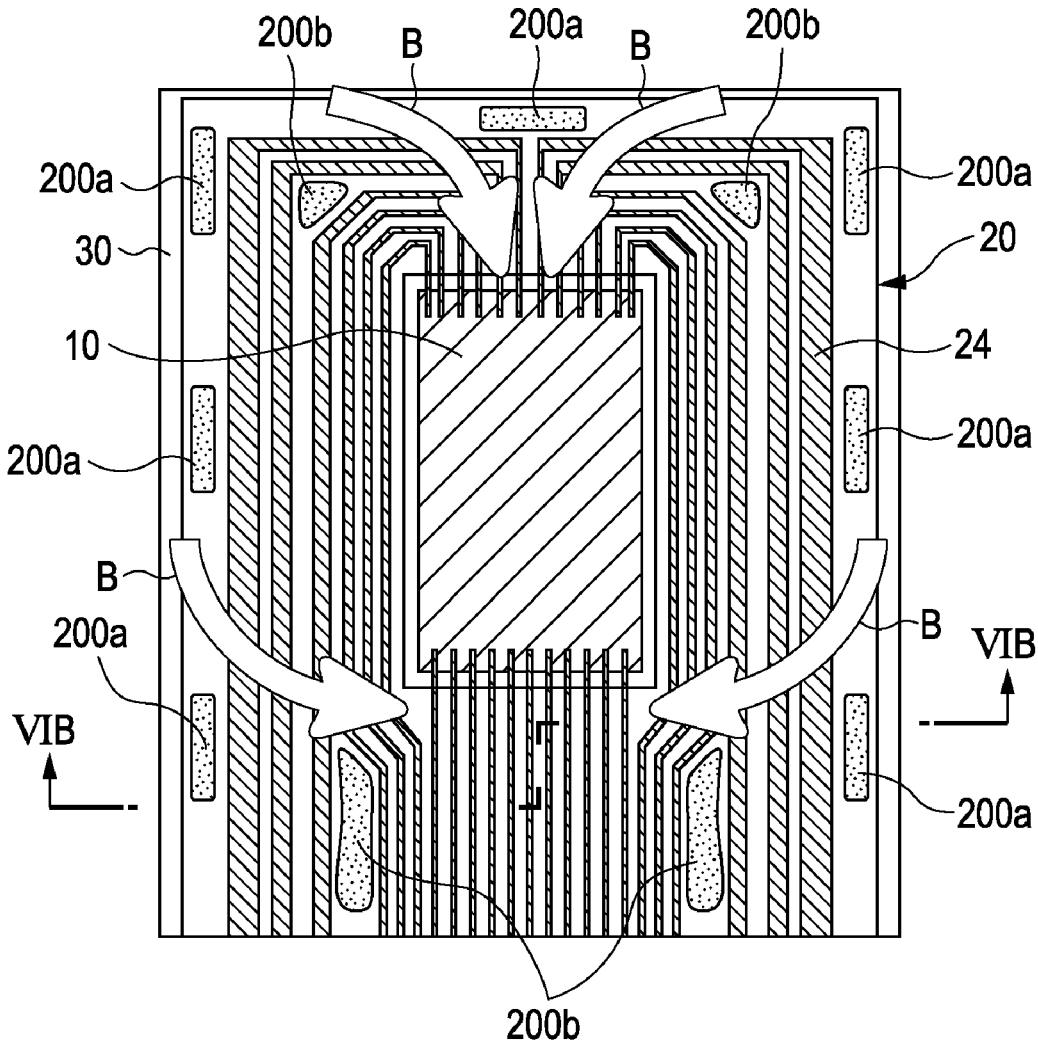
FIG. 6A is a diagram for explaining a second embodiment of the present invention.
Figure 6B:
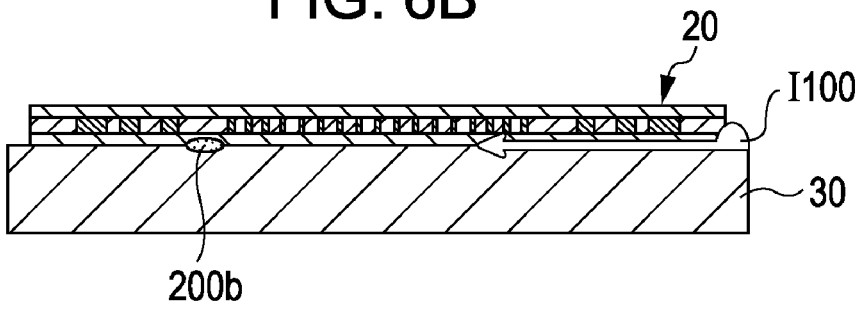
FIG. 6B is a diagram for explaining the second embodiment of the present invention.

FIG. 6A illustrates the inkjet recording head 1 viewed from the side of the recording element substrate 10. FIG. 6B is a sectional view of FIG. 6A taken along line VIB-VIB.

Ink I100 that adheres to the electric wiring substrate 20 in the peripheral area thereof may flow inward as shown by arrows B in FIG. 6A though the regions of the outer peripheral section of the electric wiring substrate 20 where the welded sections are not formed. In other words, as shown in FIG. 6B, the ink I100 may flow inward through the gaps between the electric wiring substrate 20 and the ink tank 30 in the regions where the electric wiring substrate 20 and the ink tank 30 are not welded to each other. In this case, there is a risk that the ink I100 will reach the connecting sections between the wires and the recording element substrate 10 that are not covered by the electric wiring substrate 20 but exposed. This may cause defects regarding the wires.

Accordingly, in the present embodiment, as shown in FIG. 7, in the outer peripheral section of the electric wiring substrate 20 on the first surface 31 of the ink tank 30, the welded section 210 is formed by the irradiation with the laser beam such that the welded section 210 extends continuously in the outer peripheral section excluding the bent portion 28 (see FIGS. 2A and 2B). Therefore, the risk that the ink will flow inward through the gap between the electric wiring substrate 20 and the ink tank 30 and adhere to the connecting sections between the wires 24 and the recording element substrate 10 can be reduced. As a result, the electrical reliability of the inkjet recording head can be further increased.

In addition, according to the present embodiment, welded sections 220 which also extend continuously are additionally provided along the edges of the opening 26 in the electric wiring substrate 20 in the scanning direction of the inkjet recording head. Therefore, the risk that the ink will flow inward can be further reduced.

The electric wiring substrate is fixed to the retaining member by the irradiation with the laser beam at least at a part of the outer peripheral section of the electric wiring substrate. Accordingly, the electric wiring substrate can be bonded to the retaining member with high accuracy even at edge portions of the electric wiring substrate. As a result, the risk that the electric wiring substrate will be bent by coming into contact with the recording medium can be reduced and the electrical reliability of the recording head can be increased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

REFERENCE SIGNS LIST

1 inkjet recording head (recording head)
10 recording element substrate
20 electric wiring substrate
24 wire
30 ink tank (retaining member)
200*a* welded section (welded section disposed in outer peripheral section of electric wiring substrate)

The invention claimed is:

1. A method for manufacturing a recording head including a recording element substrate, an electric wiring substrate, and a retaining member for retaining the recording element substrate and the electric wiring substrate, the recording element substrate including recording elements configured to generate energy used for ejecting liquid and a plurality of electrodes, the electric wiring substrate including a first insulator, a second insulator, and a plurality of wires disposed between the first insulator and the second insulator and being provided with an opening in which the recording element substrate is disposed, the method comprising:

welding the electric wiring substrate and the retaining member to each other by irradiating with a laser beam a contact section in which the second insulator and a surface of the retaining member on which the recording element substrate is in fixed contact at least at a part of an outer peripheral section of the electric wiring substrate, the contact section being irradiated with the laser beam through a region of the electric wiring substrate where the wires are not arranged in a direction perpendicular to the surface; and connecting the electrodes of the recording element substrate and the wires of the electric wiring substrate electrically.

2. The method for manufacturing the recording head according to claim 1, wherein the retaining member has a projecting shape in the contact section before the welding, the projecting shape projecting from the surface of the retaining member toward the contact section.

3. The method for manufacturing the recording head according to claim 1, wherein the first insulator and the second insulator are bonded to each other by an adhesive disposed between the wires, wherein the retaining member has the absorptance with respect to the laser beam and the first insulator, the second insulator, and the adhesive have the transmittance with respect to the laser beam.

4. A recording head, comprising:

a recording element substrate including recording elements configured to generate energy used for ejecting liquid and a plurality of electrodes;

an electric wiring substrate including a first insulator, a second insulator, and a plurality of wires disposed between the first insulator and the second insulator and provided with an opening in which the recording element substrate is disposed, the wires being electrically connected to the electrodes; and a retaining member for fixing the recording element substrate and the electric wiring substrate, wherein the second insulator and a surface of the retaining member on which the recording element substrate is fixed are welded by a laser beam, and a welded section is formed at least at a part of an outer peripheral section of the electric wiring substrate and at a position corresponding to a region of the electric wiring substrate where the wires are not arranged in a direction perpendicular to the surface.

5. The recording head according to claim 4, wherein one of the electric wiring substrate and the retaining member includes a section having an absorptance with respect to the laser beam and the other one of the electric wiring substrate and the retaining member includes a section having a transmittance with respect to the laser beam, and wherein the welded section is formed by directing the laser beam though the section having the transmittance.

6. The recording head according to claim 4, wherein the welded section is formed at least at a part of an edge portion of the electric wiring substrate in a direction in which the recording head is moved in the outer peripheral section of the electric wiring substrate.

7. The recording head according to claim 4, wherein the welded section is formed at a position near a corner of the electric wiring substrate.

8. The recording head according to a claim 4, wherein the first insulator and the second insulator are bonded to each other by an adhesive disposed between the wires, wherein the retaining member has the absorptance with respect to the laser beam and the first insulator, the second insulator, and the adhesive have the transmittance with respect to the laser beam.

9. The recording head according to claim 8, wherein the welded section of the second insulator is formed at a position corresponding to a region between the wires bent along the surface.

10. The recording head according to claim 4, wherein the electric wiring substrate includes a bent portion bent toward a surface of the retaining member other than the surface on which the recording element substrate is fixed, and wherein the welded section is formed such that the welded section extends continuously in the outer peripheral section of the electric wiring substrate excluding the bent portion on the surface on which the recording element substrate is fixed.

11. The method for manufacturing the recording head according to claim 1, wherein the first insulator consists of a film and the second insulator consists of a film.

12. The recording head according to claim 4, wherein the first insulator consists of a film and the second insulator consists of a film.

13. A method for manufacturing a recording head including a recording element substrate, an electric wiring substrate, and a retaining member for retaining the recording element substrate and the electric wiring substrate, the recording element substrate including recording elements configured to generate energy used for ejecting liquid and a plurality of electrodes, the electric wiring substrate including a first insulator, a second insulator, and a plurality of wires disposed between the first insulator and the second insulator, the method comprising:

welding the electric wiring substrate and the retaining member to each other by irradiating with a laser beam a contact section in which at least a part of the second insulator and a surface of the retaining member on which the recording element substrate is in fixed contact, the contact section being irradiated with the laser beam through a region of the electric wiring substrate where the wires are not arranged in a direction perpendicular to the surface; and connecting the electrodes of the recording element substrate and the wires of the electric wiring substrate electrically.

14. A recording head, comprising:

a recording element substrate including recording elements configured to generate energy used for ejecting liquid and a plurality of electrodes;

an electric wiring substrate including a first insulator, a second insulator, and a plurality of wires disposed between the first insulator and the second insulator, the wires being electrically connected to the electrodes; and a retaining member for fixing the recording element substrate and the electric wiring substrate, wherein at least a part of the second insulator and a surface of the retaining member on which the recording element substrate is fixed are welded by a laser beam and a welded section is formed at a position corresponding to a region of the electric wiring substrate where the wires are not arranged in a direction perpendicular to the surface.

* * * * *